US011549787B1

(12) United States Patent
McDougall et al.

(10) Patent No.: US 11,549,787 B1
(45) Date of Patent: Jan. 10, 2023

(54) SYSTEM FOR PREEMPTIVELY DEFEATING PASSIVE-INFRARED SENSORS

(71) Applicants: Alexandra Catherine McDougall, Andover, MA (US); Daniel Desai, Boston, MA (US); Zhiyu Xia, Shrewsbury, MA (US)

(72) Inventors: Alexandra Catherine McDougall, Andover, MA (US); Daniel Desai, Boston, MA (US); Zhiyu Xia, Shrewsbury, MA (US)

( * ) Notice: Subject to any disclaimer, the term of this patent is extended or adjusted under 35 U.S.C. 154(b) by 271 days.

(21) Appl. No.: 16/752,645

(22) Filed: Jan. 25, 2020

(51) Int. Cl.

| | |
|---|---|
| ***F41J 2/02*** | (2006.01) |
| ***F41H 3/00*** | (2006.01) |
| ***F41J 2/00*** | (2006.01) |
| ***F41J 3/00*** | (2006.01) |

(52) U.S. Cl.
CPC . *F41J 2/02* (2013.01); *F41J 2/00* (2013.01); *F41J 3/00* (2013.01); *F41H 3/00* (2013.01)

(58) Field of Classification Search
CPC . F41J 2/02; F41J 2/00; F41J 3/00; F41H 3/00
See application file for complete search history.

(56) References Cited

U.S. PATENT DOCUMENTS

| | | | | |
|---|---|---|---|---|
| 3,627,981 | A | 12/1971 | Kuhn | |
| 3,841,219 | A | 10/1974 | Schillreff | |
| 3,938,151 | A | 2/1976 | Trenam | |
| 4,240,212 | A | 12/1980 | Marshall et al. | |
| 4,346,901 | A | 8/1982 | Booth | |
| 4,838,167 | A | 6/1989 | Prahauser et al. | |
| 5,238,406 | A | 8/1993 | Littell | |
| 5,424,741 | A | 6/1995 | Genovese | |
| 5,814,754 | A | 9/1998 | Mangolds | |
| 6,521,904 | B2 | 2/2003 | Strickland | |
| 6,873,283 | B2 | 3/2005 | Zaar | |
| 8,125,369 | B1 | 2/2012 | Kang et al. | |
| 9,078,425 | B1 | 7/2015 | Heiges | |
| 2008/0087186 | A1 | 4/2008 | Blohm et al. | |
| 2008/0296842 | A1* | 12/2008 | Novak | F41J 2/02 273/348.1 |
| 2019/0022262 | A1* | 1/2019 | Andrews | A45C 15/00 |

OTHER PUBLICATIONS

Higgenbotham, Adam, "U.S. Military Learns to Fight Deadliest Weapons", WIRED (online), Jul. 28, 2010, Retrieved Jan. 19, 2020. https://web.archive.org/web/20191226120943/https://www.wired.com/2010/07/ff_roadside_bombs/, 12 pgs.

(Continued)

*Primary Examiner* — Michael C Zarroli
(74) *Attorney, Agent, or Firm* — John Brooks Law LLC; John J. Brooks, III

(57) ABSTRACT

A thermal decoy system contains electro-resistive fabric which warms the air within a polymer envelope transmissive to infrared radiation. The thermal decoy system thereby produces a thermal signature comparable to that of a human, which will preemptively trigger passive-infrared sensors, thereby neutralizing such sensors' capability to detect nearby persons.

20 Claims, 2 Drawing Sheets

(56) References Cited

OTHER PUBLICATIONS

Unknown Author, "Rhino Convoy Protection System ", U.S. Army Project Manager Close Combat Systems (online). Retrieved Jan. 19, 2020. https://www.pica.army.mil/pmccs/CombatMunitions/Defeat/Rhino.html, 1 pg.

McCarthy, Liz & Kaplun, Michael. "PM CCS Offers Revolutionary Networked Munition Systems" Infantry 98, Dec. 2009, pp. 9-11. https://www.benning.army.mil/infantry/magazine/issues/2009/AUG-DEC/pdfs/AUG-Dec2009.pdf, 3 pgs.

Horton, Alex. "Soleimani's legacy: The gruesome, advanced IEDs that haunted U.S. troops in Iraq" Washington Post, Jan. 3, 2020. https://www.washingtonpost.com/national-security/2020/01/03/soleimanis-legacy-gruesome-high-tech-ieds-that-haunted-us-troops-iraq/, 3 pgs.

* cited by examiner

SYSTEM FOR PREEMPTIVELY DEFEATING PASSIVE-INFRARED SENSORS

FIELD OF THE INVENTION

The invention pertains generally to active countermeasures against thermal detection systems. More specifically, the invention is a system for impersonating the thermal signature of a person versus passive-infrared sensors.

BACKGROUND OF THE INVENTION

Passive-infrared sensors are intended to detect the presence of a person or other warm-blooded animal by means of the long-wave infrared (thermal) radiation emitted by the body. This detection capability may be used for adverse purposes. The present invention is intended to preemptively trigger a passive-infrared sensor, thereby neutralizing the sensor's capability to detect persons in the vicinity.

SUMMARY OF THE INVENTION

A thermal element comprising electro-resistive heating fabric (such as metallized fabric, or fabric coated with an electrically conductive, polymer-based coating, or fabric otherwise manufactured such that it conducts electric current with sufficient resistance, or impedance, to convert a usable portion of said electric current to heat), which warms the air within a flexible polymer envelope; this envelope is thermally insulating, but relatively transparent to infrared in the 10-micron range, for example low-density polyethylene (LDPE). The temperature delta of the heating fabric within the envelope (henceforth referred to as the article)—compared with the surrounding environment—triggers any sensor in the vicinity.

The primary advantages of this invention are:

1. Many commercially-available passive-infrared sensors detect apparent-temperature delta only, and have no imaging capability. Therefore, if the article has a similar radiant-intensity delta to a human, and moves at about the same speed, the sensor cannot be modified to reject the article while also effectively detecting a human.
2. 'Vortex cut' of the electro-resistive fabric improves heat distribution.
3. Thermally insulating, but infrared-transparent (example: LDPE) envelope retains heat and protects from moisture, dust, etc.
4. Lightweight and easily transportable. In at least one embodiment of the present invention, the article has a mass of about 500 grams and can be flat-packed in a 16x24-inch (40x60 cm) container.
5. May be manually placed, thrown, or delivered by means of an unmanned aerial vehicle, unmanned ground vehicle, or other craft capable of moving and loitering in a three-dimensional environment.

A more complete understanding of the specific nature and advantages of the present invention may be realized by reference to the remaining portions of the specification as well as to the drawings.

DETAILED DESCRIPTION OF THE INVENTION

A lightweight, flexible, substantially airtight, and water-resistant envelope 100 is provided. The envelope 100 may be constructed of low-density polyethylene (LDPE), the same material as used for commercially-available, passive-infrared sensor windows, and used for zip-top storage bags.

Figure 1:
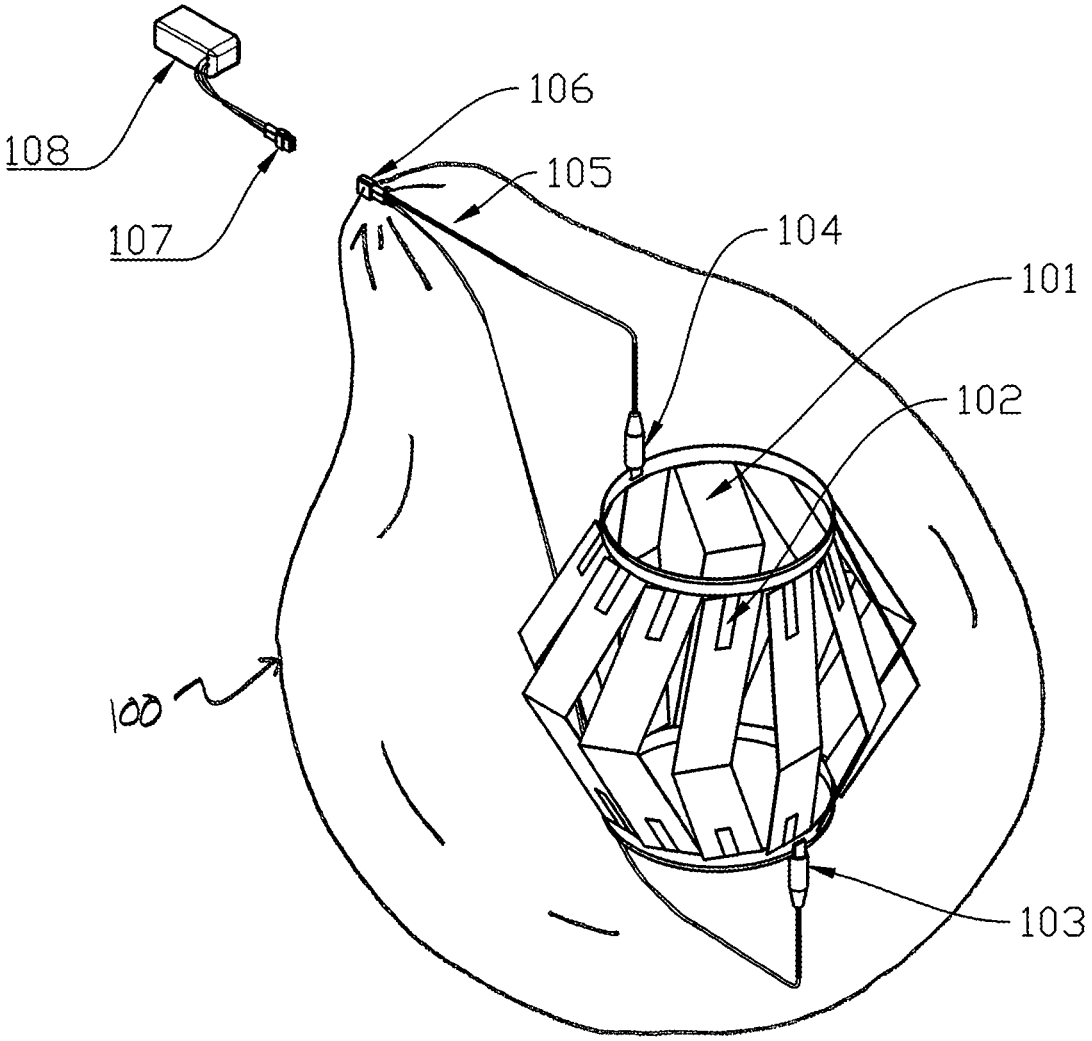
FIG. 1: Isometric view of the complete system.
Figure 2:
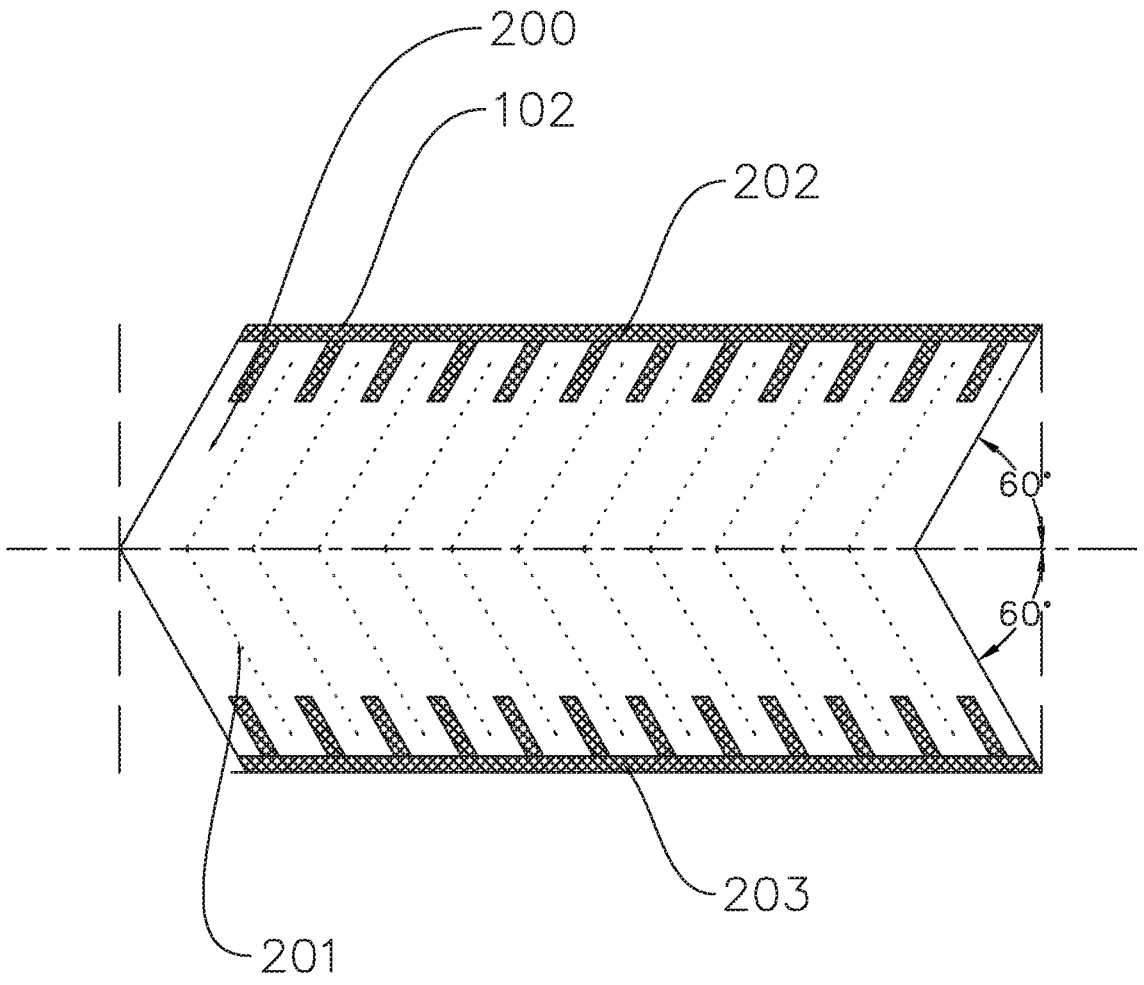
FIG. 2: Plan view of the resistive heating element.

A thermal heating element 101 is composed of electro-resistive heating fabric (example: Eeonyx brand, non-woven healing fabric) 200, with copper or other metallic conductive tape 102, placed as shown in FIG. 1 and FIG. 2. A number of slits 201 are cut in the fabric 200 to allow the article to expand outwards, once unpacked, and for improved heat distribution. In at least one embodiment of the present invention, a non-conductive, heat-resistant spacer or tensioning device may be provided to maintain the thermal heating element 101 in an expanded state. It should be noted, however, that the use of such spacer or tensioning device is only one of a number of possible methods of unfolding the thermal heating element 101, expanding the envelope 100, and maintaining such expansion which may be successfully employed.

Power is delivered from an external battery pack 108 or other suitable source, to the thermal heating element 101 by means of power cable 105. In at least one embodiment of the present invention, the power cable 105 is electrically and mechanically connected to the conductive tape 102 at positive attachment point 202 and negative attachment point 203 by positive connector 104 and negative connector 103. It should be noted, however, that this configuration is only one of a number of possible methods of securing the power cable 105 to the thermal element 101 which may be successfully employed.

In at least one embodiment of the present invention, a quick-release connector 106 is provided to connect the article with the external power supply connector 107. It should be noted, however, that this configuration is only one of a number of possible methods of connecting and disconnecting the article to and from an external power supply which may be successfully employed.

EMPIRICAL EVIDENCE, RESEARCH, AND EXPERIMENTATION

When, in at least one embodiment of the present invention, the article is supplied with 15-27 volts at 0.6-1.5 amperes, it radiates a thermal profile (65-172 watts/meter-squared), comparable to a human. In tests of one embodiment of the present invention, the system reliably triggered commercially-available, passive-infrared sensors. Specifically, the tests—conducted against a Doberman SE-0104 passive-infrared sensor—demonstrated consistent triggering at 30 feet, intermittent triggering at 45 feet, and a single instance of triggering at 90 feet, when the article was placed on a zipline.

What is claimed is:

1. A thermal decoy system, comprising:

electro-resistive fabric;

a substantially airtight envelope;

electrically conductive connectors; and an electrical power source in communication with the electro-resistive fabric, whereby said thermal decoy system preemptively triggers passive-infrared sensors by heating the electro-resistive fabric to produce a thermal signature comparable to that of a human.

2. The thermal decoy system, according to claim 1, wherein the electro-resistive fabric comprises one of:

a fabric with electro-resistive coating, or a woven or non-woven fabric of electro-resistive textile material, or a fabric containing a blend of said electro-resistive textile material and a conventional textile material.

3. The thermal decoy system, according to claim 1, wherein the electro-resistive fabric is cut such as to optimize heat distribution and foldability of the thermal decoy system for transport.

4. The thermal decoy system, according to claim 1, wherein the substantially airtight envelope is constructed of polymer material transmissive to infrared radiation.

5. The thermal decoy system, according to claim 1, wherein;

the electrically conductive connectors comprise one selected from the group consisting of:

a conductive tape, a conductive foil, and a conductive thread; and the electrically conductive connectors are substantial conformable to the electro-resistive fabric.

6. The thermal decoy system, according to claim 1, further compromising:

a means for unfolding the electro-resistive fabric and expanding the substantially airtight envelope; and said means compromises one selected from the group consisting of:

a mechanical device, a pneumatic device, an electrical device, a pyrotechnic device, and a combination thereof.

7. The thermal decoy system, according to claim 1, wherein the electrical power source comprises one selected from the group consisting of:

primary batteries, secondary batteries, other means for generating electrical power, or a combination thereof.

8. The thermal decoy system, according to claim 1, wherein the electro-resistive fabric comprises a woven fabric of electro-resistive textile material.

9. The thermal decoy system, according to claim 1, wherein:

the electro resistive fabric is configured to be retained within and heat air within the substantially airtight envelope;

the substantially airtight envelope comprises a flexible polymer envelope transparent to infrared radiation; and the flexible polymer envelope is configured to retain the heated air to provide the thermal signature.

10. The thermal decoy system, according to claim 9, wherein:

the electro-resistive fabric is cut with a plurality of vortex cuts whereby the electro-resistive fabric is configured to be connected at the ends of its length to create a cylindrical hollow shell shape to radially distribute heat from the electro-resistive fabric; and the thermal decoy system further comprises a heat-resistant spacer to maintain the electro-resistive fabric in the cylindrical hollow shell shape.

11. A portable thermal decoy system, comprising:

a material configured to create a substantially airtight envelope;

an electro-resistive fabric configured to he retained within the substantially airtight envelope;

one or more electrically conductive connection in communication with the electro-resistive fabric; and an electrical power source configured to power the electro-resistive fabrics and produce a temperature delta whereby the temperature delta is configured to trigger an infrared sensor.

12. The portable thermal decoy system of claim 11 wherein the material to create the substantially airtight envelope comprises an infrared-transparent material configured to retain heat with in the thermally insulating envelope.

13. The portable thermal decoy system of claim 12 wherein the material to create the substantially airtight envelope comprises a polyethylene.

14. The portable thermal decoy system of claim 11 wherein:

the temperature delta is a thermal profile of 65-172 watts/meter-squared; and the thermal profile is comparable to a thermal profile of a human whereby the thermal profile is configured to trigger the infrared sensor.

15. The portable thermal decoy system of claim 11 wherein:

the portable thermal decoy is configured to allow a movement of the portable thermal decoy;

the temperature delta is a thermal profile of 65-172 watts/meter-squared;

the thermal profile is comparable to a thermal profile of a human;

a passive-infrared sensor having an imaging capability configured to detect the movement of the portable thermal decoy; and the movement of the portable thermal decoy and thermal profile are configured to trigger the passive-infrared sensor.

16. The portable thermal decoy system of claim 11 wherein the electro-resistive fabric comprises one selected from the group consisting of:

a fabric with electro-resistive coating;

a woven or non-woven fabric of electro-resistive textile material; and a fabric containing a blend of (a) the electro-resistive textile material and (b) a conventional textile material.

17. The portable thermal decoy system of claim 11 wherein the electro-resistive fabric is cut with a plurality of vortex cuts whereby the electro-resistive fabric is configured to be connected at the ends of its length to create a cylindrical hollow shell and extended across its width to radially distribute heat from the electro-resistive fabric.

18. The portable thermal decoy system of claim 11 wherein:

the portable thermal decoy system is configured to have a mass of about 500 grams; and the portable thermal decoy system is configured to be flat-packed in a container of about 16 inches by 24 inches.

19. The portable thermal decoy system of claim 11 wherein the portable thermal decoy system is configured to be delivered by a vehicle configured to move and loiter in a three-dimensional environment.

20. portable thermal decoy system, comprising:

a material configured to create a substantially airtight envelope;

the material to create the substantially airtight envelope comprises an infrared-transparent material configured to retain heat with in the substantially airtight envelope;

an electro-resistive fabric configured to be retained within the substantially airtight envelope;

the electro-resistive fabric is cut with a plurality of vortex cuts whereby the electro-resistive fabric is configured to be connected at the ends of its length to create a cylindrical hollow shell and extended across its width to radially distribute heat from the electro-resistive fabric;

one of a heat-resistant spacer or a tensioning device configured to maintain the electro-resistive fabric in a cylindrical hollow shell shape;

one or more electrically conductive connection in communication with the electro-resistive fabric;

an electrical power source configured to power the electro-resistive fabric and produce a temperature delta whereby the temperature delta is configured to trigger an infrared sensor;

the portable thermal decoy is configured to be portable to create a movement of the portable thermal decoy;

the temperature delta is a thermal profile of 65-172 watts/meter-squared; the thermal profile is comparable to a thermal profile of a human;

a passive-infrared sensor having an imaging capability configured to detect the movement of the portable thermal decoy;

the movement of the portable thermal decoy and the thermal profile are configured to trigger the passive-infrared sensor;

the portable thermal decoy system is configured to have a mass of about 500 grams;

the portable thermal decoy system is configured to be flat-packed in a container of about 16x24 inches; and the portable thermal decoy system is configured to be delivered by a vehicle configured to move and loiter in a three-dimensional environment; and the vehicle comprises one of the group consisting of:

an unmanned aerial vehicle, and an unmanned ground vehicle.

* * * * *